US006601586B2

(12) United States Patent
Herrick

(10) Patent No.: US 6,601,586 B2
(45) Date of Patent: Aug. 5, 2003

(54) PIPE WITH IMPROVED CUTTING EDGE

(76) Inventor: Mark Herrick, 541 W. Packard Ave., Ft. Wayne, IN (US) 46807

( * ) Notice: Subject to any disclaimer, the term of this patent is extended or adjusted under 35 U.S.C. 154(b) by 0 days.

(21) Appl. No.: 09/779,660

(22) Filed: Feb. 9, 2001

(65) Prior Publication Data

US 2002/0108624 A1 Aug. 15, 2002

(51) Int. Cl.[7] ..... A24F 1/28

(52) U.S. Cl. ..... 131/191; 131/229; 131/226; 131/330; 131/175; D27/163

(58) Field of Search ..... 131/229, 230, 131/191, 221, 226, 175, 188, 187, 190, 330, 257; D27/163

(56) References Cited

U.S. PATENT DOCUMENTS

| | | | | | |
|---|---|---|---|---|---|
| 175,877 | A | * | 4/1876 | Ross, Jr. | 1321/191 |
| D10,018 | S | | 5/1877 | Demuth | |
| D35,637 | S | | 1/1902 | Comstock | |
| 1,591,743 | A | | 7/1926 | Chance | |
| 1,825,946 | A | * | 10/1931 | Foehr | 131/190 |
| 1,976,653 | A | * | 10/1934 | Brueck | 131/258 |
| D143,786 | S | | 2/1946 | Arnold | |
| 2,594,680 | A | | 4/1952 | Rehfeld | |
| D167,231 | S | | 7/1952 | Rehfeld | |
| 2,644,464 | A | * | 7/1953 | Lancaster | 131/191 |
| 3,058,476 | A | * | 10/1962 | Atkins | 131/187 |
| 3,766,929 | A | | 10/1973 | Roman, Jr. | |
| 3,830,243 | A | | 8/1974 | Bruget | |
| 4,151,849 | A | | 5/1979 | Beck | |
| 4,206,770 | A | | 6/1980 | Ozgener | |
| 4,478,228 | A | | 10/1984 | Chister | |
| 6,129,398 | A | | 10/2000 | Calhoun | |

FOREIGN PATENT DOCUMENTS

| | | | | |
|---|---|---|---|---|
| FR | 839190 | * | 3/1939 | 131/191 |
| GB | 575 | * | 1/1900 | 131/191 |

* cited by examiner

*Primary Examiner*—Steven P. Griffin
*Assistant Examiner*—Dionne A. Walls
(74) *Attorney, Agent, or Firm*—Richard C. Litman

(57) ABSTRACT

A smoker's pipe comprises a tubular member having a tobacco-retaining concavity at the front end. A plurality of evenly spaced cutting teeth form the edge of the concavity, such that a supply of tobacco can be cut for retention in the concavity. An opening extends from the bottom of the concavity to the rear end of the tubular member.

5 Claims, 2 Drawing Sheets

PIPE WITH IMPROVED CUTTING EDGE

BACKGROUND OF THE INVENTION

1. Field of the Invention

The present invention generally relates to smoking accessories. More specifically, the present invention is drawn to a smoker's pipe having a unique cutting edge which permits easy and efficient tobacco retrieval.

2. Description of the Related Art

Prior art tobacco pipes usually require that the tobacco is retrieved from the tobacco container by hand, cut (if necessary) and packed into the bowl of the pipe. This procedure is messy and often results in lost tobacco because of spills. Examples of such prior art pipes are shown in U.S. Pat. Nos. Des. 10,018 (Demuth), Des. 35,637 (Comstock), Des. 143,786 (Arnold), Des. 167,231 (Rehfeld), 1,591,743 (Chance) and 2,594,680 (Rehfeld). None of the above patents disclose any apparatus for cutting tobacco.

U.S. Pat. No. 3,766,929 (Roman, Sr.) shows a procedure for producing a cartridge of smoking tobacco. This procedure requires a separate apparatus aside from the pipe, and is inefficient when compared with the invention as disclosed herein.

Devices for tamping tobacco are disclosed in U.S. Pat. Nos. 3,830,243 (Bruget) and 4,206,770 (Ozgener). Neither patentee contemplates tobacco cutting and retrieval from a receptacle.

U.S. Pat. Nos. 4,151,849 (Beck) and 4,478,228 (Chister) show apparatus for storing tobacco in pipes. There is no provision for cutting and retrieving tobacco from a receptacle.

U.S. Pat. No. 6,129,398 (Calhoun) discloses a device for removing smokeless tobacco from a receptacle. No provision is contemplated for cutting the tobacco or efficiently loading the tobacco in the bowl of a pipe.

None of the above inventions and patents, taken either singularly or in combination, is seen to disclose a tobacco cutting and retrieval pipe as will subsequently be described and claimed in the instant invention.

SUMMARY OF THE INVENTION

The instant invention is drawn to a smoker's pipe and comprises a tube-shaped member which has a longitudinal opening coincident with the tube's longitudinal axis. A first end of the member is configured as a bowl having a peripheral rim formed with multiple, evenly-spaced slots so as to create a plurality of relative sharp teeth, which teeth are capable of cutting smokeless tobacco. The bowl is sized to contain an amount of tobacco sufficient for smoking. The tobacco is of the many known commercial types normally sold in tobacco tins or the like. The invention functions to make loading the pipe a quick, efficient and clean procedure.

Accordingly, it is a principal object of the invention to provide a smoker's pipe, which pipe can be efficiently loaded with tobacco.

It is another object of the invention to provide a smoker's pipe, which pipe can be loaded without direct hand contact with the tobacco.

It is a further object of the invention to provide a smoker's pipe, which pipe is equipped with means for cutting the tobacco.

Still another object of the invention is to provide a smoker's pipe, which pipe is easy to use.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 2:
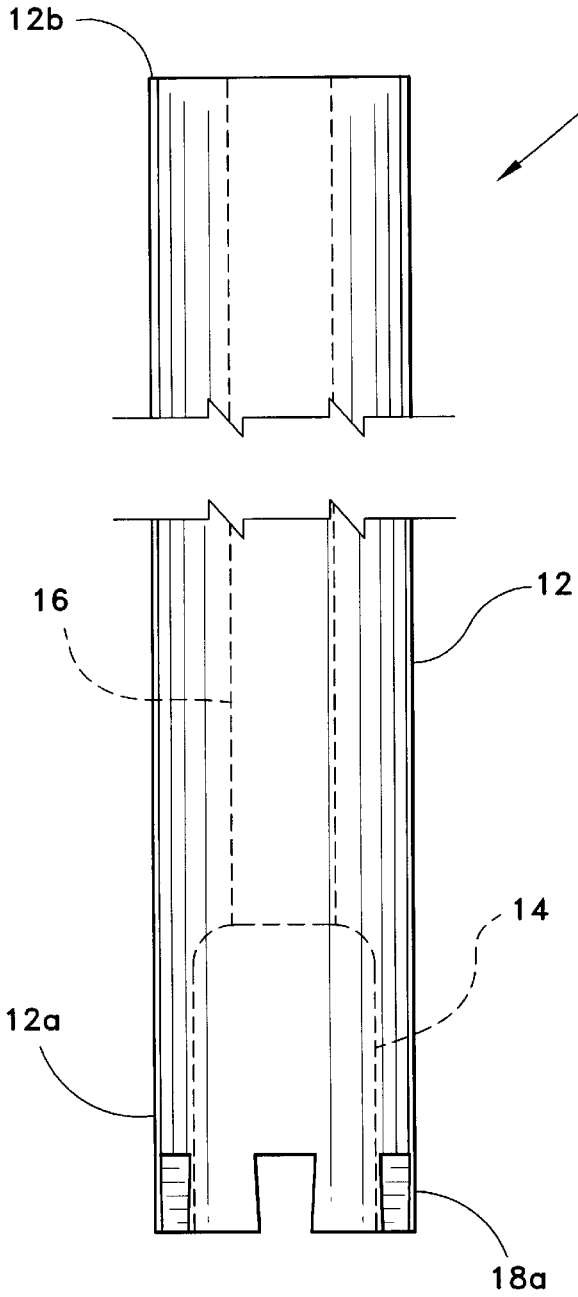
FIG. 2 is a side view of a smoker's pipe with an improved cutting edge according to the present invention.
Figure 3:
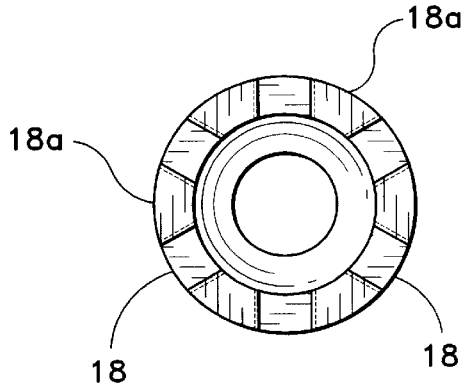
FIG. 3 is an end view of a smoker's pipe with an improved cutting edge according to the present invention.

Attention is first directed to FIGS. 2 and 3 wherein the smoker's pipe of the instant invention is generally indicated at 10. Smoker's pipe 10 comprises a tubular member 12 having respective forward and rear ends 12*a*, 12*b*. In the preferred embodiment, member 12 is approximately three inches long and has an outside diameter of approximately five-sixteenths of an inch. A concavity is formed at forward end 12*a* so as to form a bowl 14 therein. The inside diameter of bowl 14 is approximately seven thirty-seconds of an inch. Bowl 14 is formed with a depth of approximately three-eighths of an inch. A one-eighth inch opening 16 is centered at the bottom of the bowl and extends through the entirety of tubular member 12 exiting at rear end 12*b*. An evenly spaced series of one-sixteenth of an inch slots 18 are formed at the forward end 12*a*. The slots are cut at a very slight angle so as to form a series of teeth 18*a* having free ends which define the forward-most extremity of end 12*a*. Although the above indicated dimensions are preferred, it is recognized that the pipe's dimensions may be varied if desired. As contemplated, pipe 10 will be fabricated from brass, although other suitable materials may be utilized.

Figure 1:
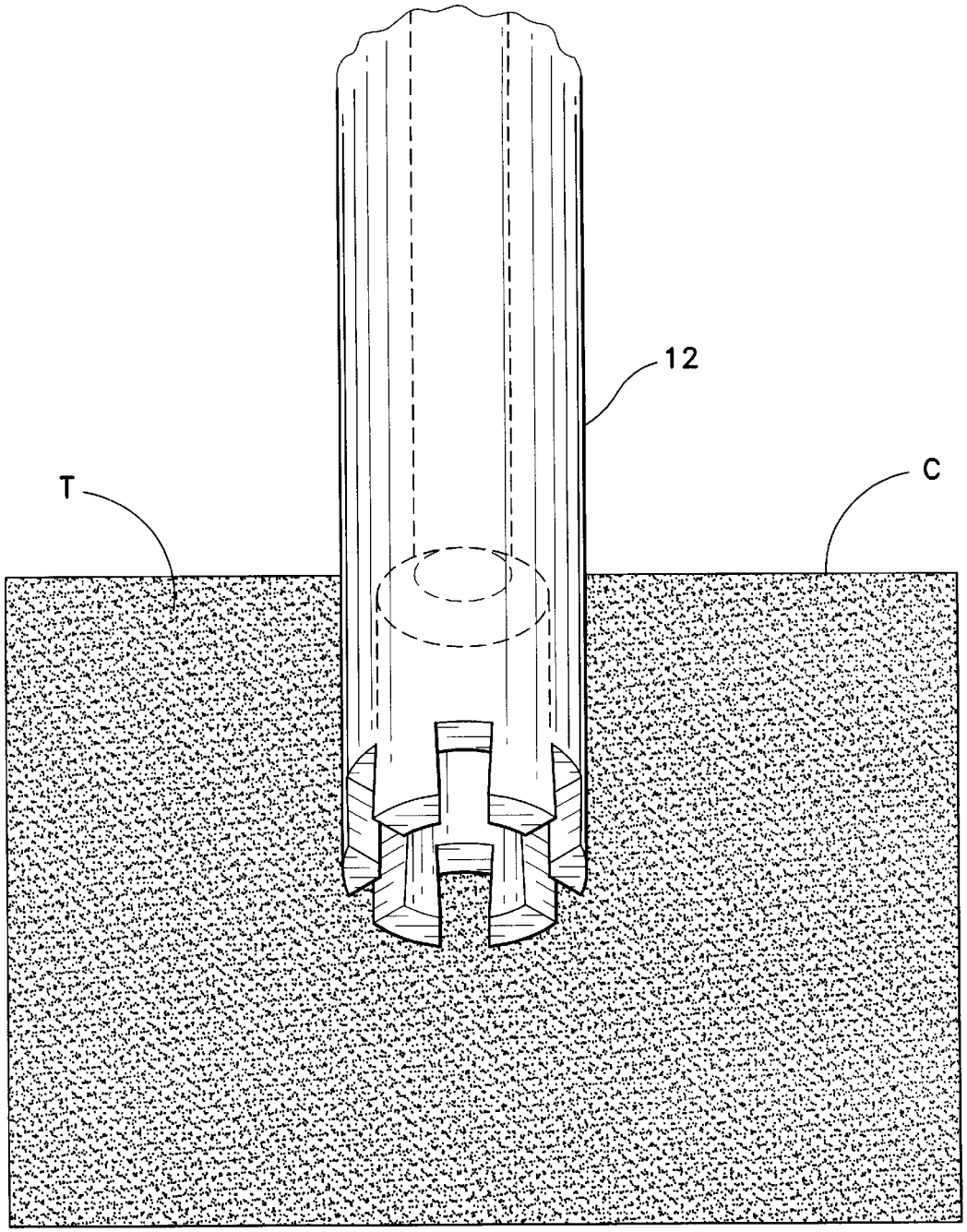
FIG. 1 is an environmental, perspective view of a smoker's pipe with improved cutting edge according to the present invention.

FIG. 1 best illustrates the technique for using the smoker's pipe of the instant invention. Such use merely requires the insertion of the forward end 12*a* into a supply of tobacco T. A slight twist will cause teeth 18*a* to perform a cutting action such that bowl 14 will be filled with tobacco. The pipe is then withdrawn from tobacco container C, ready for lighting and enjoying a pleasurable smoke.

It is to be understood that the present invention is not limited to the embodiment described above, but encompasses any and all embodiments within the scope of the following claims.

I claim:

1. A smoker's pipe comprising:

a tubular member, said tubular member having a front end and a rear end, said tubular member having a longitudinal axis extending a length between said front end and said rear end;

a concavity extending a distance into said front end for retaining an amount of tobacco therein, said concavity having an open end defined by a peripheral edge and a partially closed bottom portion;

a passageway, said passageway having a first end opening into said bottom portion of said concavity, said passageway extending from said bottom portion of said concavity and having an open second end which terminates at the rear end of said tubular member; and a plurality of teeth evenly spaced around the peripheral edge and extending therefrom in a direction parallel with said longitudinal axis, said teeth adapted to cut an amount of tobacco.

2. A smoker's pipe as defined in claim 1, wherein said plurality of teeth have free ends defining a forward-most extremity of said front end.

3. A smoker's pipe as defined in claim 2, wherein said tubular member is fabricated from brass.

4. A smoker's pipe as defined in claim 3, wherein the length of said tubular member is approximately three inches.

5. A smoker's pipe as defined in claim 4, wherein said distance the concavity extends into said front end is approximately three-eighths of an inch.

* * * * *